United States Patent [19]

Schlie

[11] Patent Number: 5,055,741

[45] Date of Patent: Oct. 8, 1991

[54] LIQUID COOLANT FOR HIGH POWER MICROWAVE EXCITED PLASMA TUBES

[75] Inventor: LaVerne A. Schlie, Albuquerque, N. Mex.

[73] Assignee: The United States of America as represented by the Secretary of the Air Force, Washington, D.C.

[21] Appl. No.: 553,928

[22] Filed: Jul. 13, 1990

[51] Int. Cl.[5] ..... H01J 7/46

[52] U.S. Cl. ..... 315/39; 313/22

[58] Field of Search ..... 372/35; 313/22; 315/39

[56] References Cited

U.S. PATENT DOCUMENTS

| | | | |
|---|---|---|---|
| 3,401,302 | 9/1968 | Thorpe et al. | 313/22 |
| 3,641,389 | 2/1972 | Leidigh | 313/36 |
| 3,876,901 | 4/1975 | James | 313/36 |
| 3,885,984 | 5/1975 | Wright | 106/287 |
| 4,045,119 | 8/1977 | Eastgate | 350/96 |
| 4,500,996 | 2/1985 | Sasnett et al. | 372/19 |
| 4,617,667 | 10/1986 | Penn | 372/35 |
| 4,715,039 | 12/1987 | Miller et al. | 372/37 |
| 4,737,678 | 4/1988 | Hasegawa | 313/36 |
| 4,868,450 | 9/1989 | Colterjohn, Jr. | 313/36 |
| 4,933,650 | 6/1990 | Okamoto | 315/39 |

*Primary Examiner*—James W. Davie

*Attorney, Agent, or Firm*—Bobby D. Scearce; Donald J. Singer

[57] ABSTRACT

A coolant system for a high power microwave excited plasma tube is described which comprises liquid dimethyl polysiloxane in a coolant system structure for flowing the liquid into contact with the plasma tube, the system structure comprising metallic or hard plastic materials.

3 Claims, 4 Drawing Sheets

LIQUID COOLANT FOR HIGH POWER MICROWAVE EXCITED PLASMA TUBES

RIGHTS OF THE GOVERNMENT

The invention described herein may be manufactured and used by or for the Government of the United States for all governmental purposes without the payment of any royalty.

CROSS REFERENCE TO RELATED APPLICATION

The invention described herein is related to copending application Ser. No. 07/553,929 filed July 13, 1990, U.S. Pat. No. 5,008,593, entitled COAXIAL LIQUID COOLING OF HIGH POWER MICROWAVE EXCITED PLASMA UV LAMPS.

BACKGROUND OF THE INVENTION

The present invention relates generally to systems for generating microwave excited plasma discharges, and more particularly to novel materials and systems for effectively cooling high power microwave plasma tubes.

Microwave excited electrodeless discharges exhibit many attractive features for plasma excitation (cw and pulsed) of low and high pressure gas in both lasers and lamps. First, such discharges appear to be inherently more stable in larger volumes and higher pressures than other types of d.c. self-sustained discharges, which stability can enable significant increases in volumetric power loading levels into the plasma. Second, the absence of metal electrodes allows discharges to be contained within either quartz or ceramic tubes, and are therefore particularly attractive for corrosive gases such as halogens and metal vapors. Electrodeless discharges may also provide greatly enhanced stable (quiescent) plasmas in large volumes, discharge pressure scaling, increased microwave power loading per unit volume, greatly reduced gas contamination, longer lifetimes for reliable operation, and elimination of cataphoresis (particularly relevant to metal vapor lasers).

Of the aforementioned microwave discharge properties, the increase in power loading into the plasmas is a prominent consideration. Increased power loadings, however, may result in temperatures (>1000° C. for quartz) sufficient to melt the plasma container walls (typically quartz or ceramic) or otherwise to cause structural failure (thermally induced cracks or softening) in the plasma containment apparatus. Such failures may occur for uncooled cw microwave power loadings greater than a few tens of watts/cm$^3$. Further, very high plasma tube wall temperatures can affect the kinetics of the plasma, a notable example being the $CO_2$ laser. Consequently, gaseous or liquid cooling is essential for the plasma containment walls. Concentric high gaseous flow cooling is usually ineffective in removing excess heat because of low heat transfer between the containment walls and the gaseous coolant, and may also produce high noise levels.

Liquids have much greater cooling capacities than gases and make direct substantial contact with the plasma tube walls. Conventionally used liquids, however, do not exhibit all the desirable optical, microwave and physical properties, and are generally either high microwave absorbers (e.g., water at 2450 MHz), dangerously unsafe (e.g., $CS_2$, $CCl_4$), flammable (e.g., benzene, other medium weight hydrocarbons, pentane, and butane), and/or non-transmissive in the UV (e.g., hydraulic fluids).

Desirable properties of a liquid coolant for microwave excited UV lamps include good ultraviolet and visible transmission, low microwave absorption at the microwave operating frequency, ability to withstand high cw and pulsed UV and visible radiation fluences, non-toxicity and non-flammability, large infrared absorption, and desirable physical and chemical properties (low viscosity, low vapor pressure, large heat capacity, high thermal conductivity). The invention herein substantially solves the problems suggested above with conventional liquid cooling for microwave excited plasmas by providing coolant comprising suitably contained dimethyl polysiloxane exhibiting substantially all of the desired optical/microwave properties mentioned above, and can be used over a wide temperature range, −73° C. to 260° C.

It is therefore a principal object of the invention to provide safe and reliable liquid cooling for high power microwave excited plasma tubes.

It is a further object of the invention to provide liquid coolant for high power microwave excited plasma tubes with application over a wide operating temperature range.

It is another object of the invention to provide high power microwave excited plasma tube liquid coolant which transmits efficiently in the UV and visible.

It is another object of the invention to provide high power microwave excited plasma tube liquid coolant having low microwave absorption.

It is another object of the invention to provide liquid coolant producing significant absorption of IR radiation emitted from high power microwave excited plasma tubes.

These and other objects of the invention will become apparent as a detailed description of representative embodiments proceeds.

SUMMARY OF THE INVENTION

In accordance with the foregoing principles and objects of the invention, a coolant system for a high power microwave excited plasma tube is described which comprises liquid dimethyl polysiloxane in a coolant system structure for flowing the liquid into contact with the plasma tube, the system structure comprising metallic or hard plastic materials.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
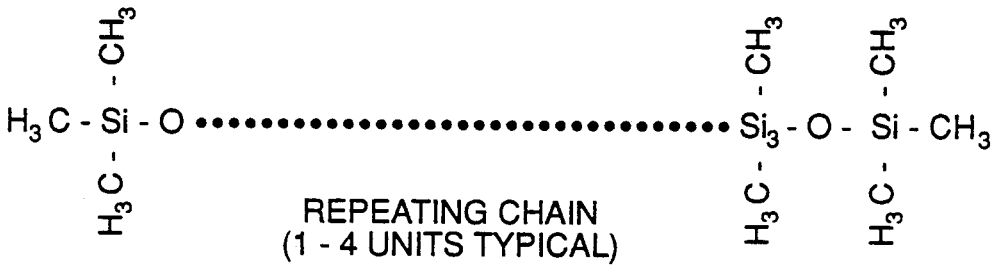
FIG. 1 shows the of dimethyl polysiloxane.
Figure 2A:
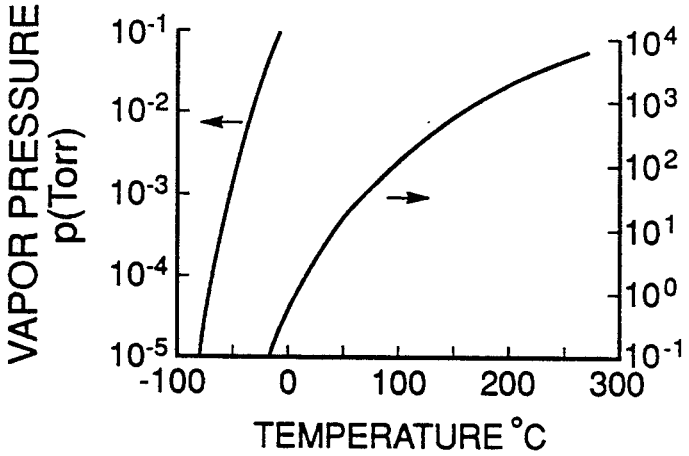
FIGS. 2*a*, 2*b*, 2*c*, 2*d* and 2*e* curves of vapor pressure, specific heat, viscosity, thermal conductivity and density versus temperature for dimethyl polysiloxane.
Figure 2B:
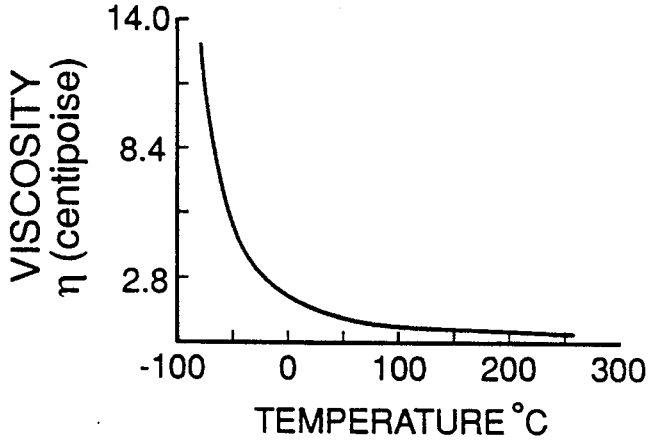
Figure 2C:
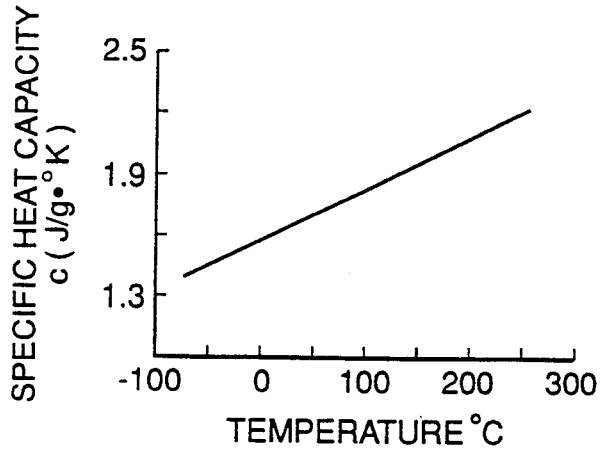
Figure 2D:
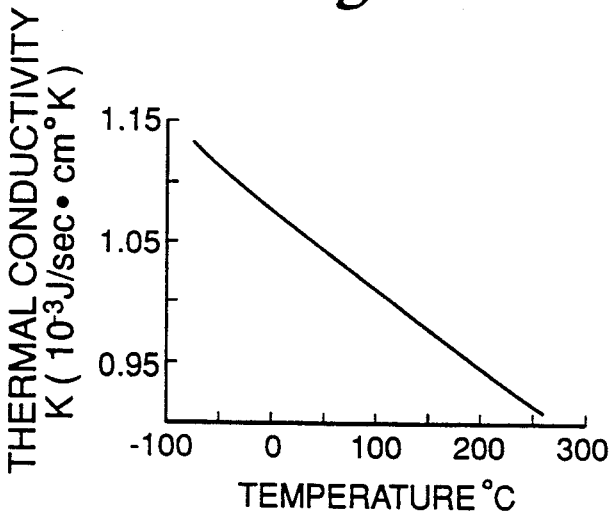
Figure 2E:
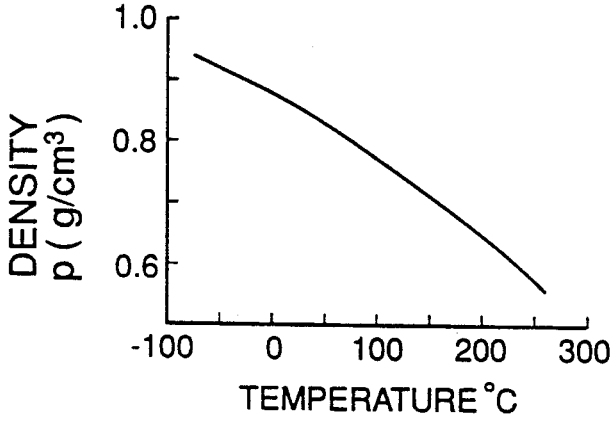

In accordance with a governing principle of the invention, it was discovered that dimethyl polysiloxane may be an extremely useful liquid coolant in cooling high power microwave (2450 MHz) plasma tubes. Referring now to FIG. 1, depicted therein is the structure of dimethyl polysiloxane. This material is a substantially clear liquid having a silicon based hydrocarbon straight chain type molecule with an average mass of about 320 amu and 1–4 repeating chain units in each molecule. Such simple hydrocarbon chains do not have rotational transitions in the microwave region of the spectrum (specifically 2450 MHz), and usually have very low ultraviolet (UV) absorption. The material is non-toxic and non-flammable. Referring now to FIGS. 2*a–e*, shown therein are plots of various important physical properties of dimethyl polysiloxane in the temperature range −73° to 260° C., including vapor pressure (FIG. 2*a*), viscosity (FIG. 2*b*), specific heat capacity (FIG. 2*c*), thermal conductivity (FIG. 2*d*) and density (FIG. 2*e*). Dimethyl polysiloxane has a very low viscosity (about 20% lower than denatured alcohol) and remains a clear liquid from −73° to 260° C. The magnitude of the specific heat capacity and thermal conductivities are comparable to those of water, and the density is slightly lower than water. Dimethyl polysiloxane has an autoignition point of 350° C., forms no carbonaceous solid materials at temperatures to 260° C. and freezes at about −93° C.

Figure 4:
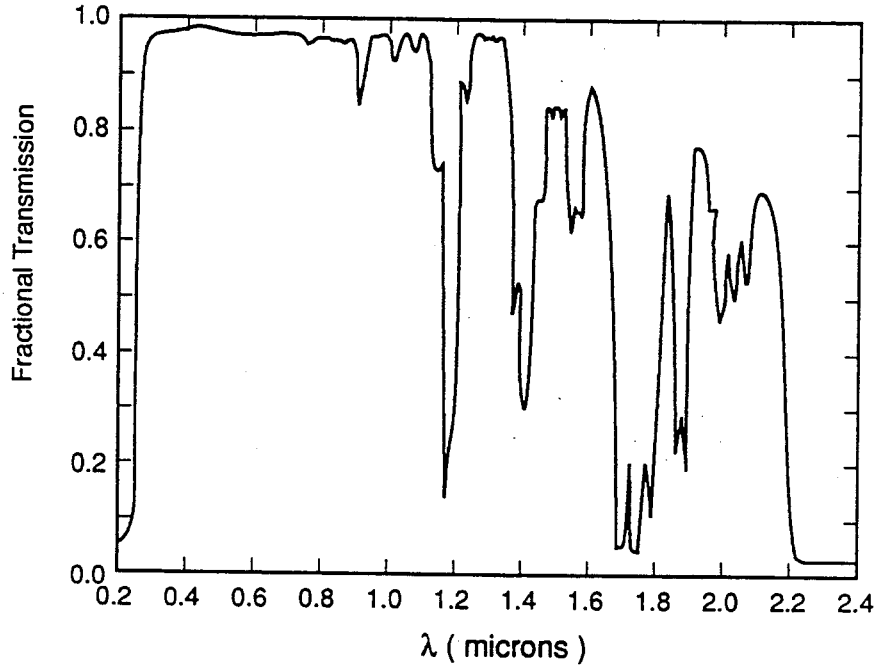
FIG. 4 shows infrared transmission of dimethyl polysiloxane.
Figure 3:
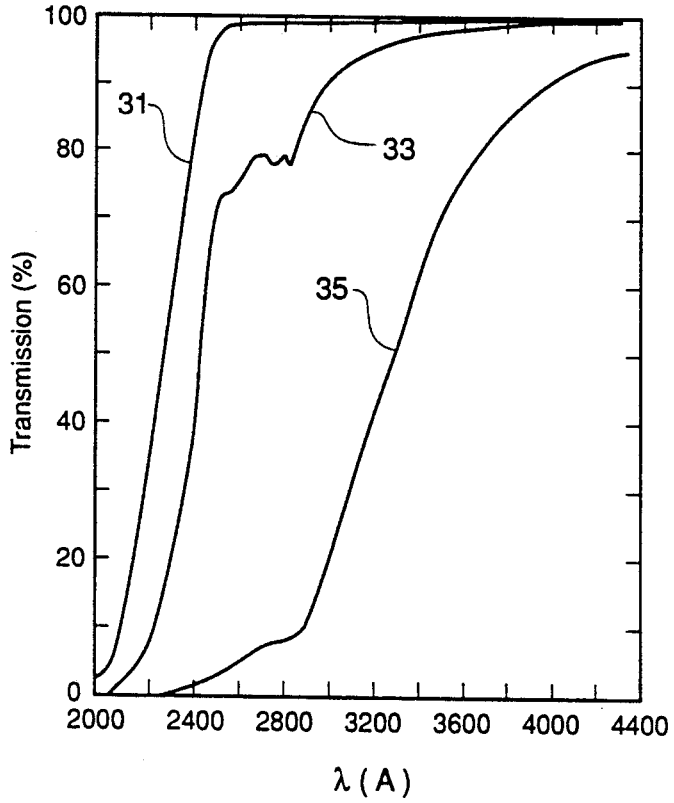
FIG. 3 shows ultraviolet transmission curves of dimethyl polysiloxane in the range 2000–4400 Å for three different storage container materials.

Dimethyl polysiloxane is characterized by high transmission of UV ($\lambda > 2200$ Å), visible and infrared (IR) radiation emitted from a plasma. It is noted that, in accordance with an important aspect of the invention, UV transmittance of dimethyl polysiloxane may be substantially affected by conditions under which it is stored and used, i.e., materials of construction for the storage containers and for the cooling system for the microwave plasma tube. Referring now to FIG. 3, shown therein are UV transmission spectra for dimethyl polysiloxane stored under three different conditions. The UV spectra data was collected using a Cary Model 2400 spectrometer with a test cell length of one centimeter. FIG. 4 shows IR transmission of the material to about 2.4 microns. In FIG. 3, curve 31 is the UV spectrum of fresh liquid dimethyl polysiloxane obtained from the manufacturer and stored in steel drums prior to use; curve 31 indicates that fresh material so stored starts transmitting at $\lambda < 2000$ Å (3%) and reaches nearly 100% transmission at about 2500 Å, which transmission extends substantially to about 0.8 micron as seen in FIG. 4. Curve 33 is the spectrum of dimethyl polysiloxane stored in a polyethylene container which indicates some impairment of UV transmission for the material at about 2400–3000 Å; mere storage of the material in a polyethylene container causes the UV transmission to significantly decrease both in its threshold wavelength and its maximum transmission (only 75% at 2800 compared to that for fresh liquid, curve 31). If the liquid is stored in or transferred by soft plastic materials, such as neoprene or polyflow, the UV transmittance is substantially reduced as exemplified by curve 35. Curve 35 shows the UV transmission spectra for liquid stored in soft plastic container material to have a threshold wavelength approximately 2800 Å plus a greatly decreased transmission thereabove. It is noted therefore that, in accordance with a principal feature of the invention, the dimethyl polysiloxane liquid coolant must be stored in containers, and utilized in a system, of material such as stainless steel, aluminum, brass, copper, glass (pyrex, quartz, etc.) or the like or in hard plastics such as acrylic, plexiglass or Lexan TM.

The IR absorption by liquid dimethyl polysiloxane is substantial above one micron as evidenced by the IR spectrum shown in FIG. 4; this spectrum was produced using the Cary 2400 spectrometer and further indicates substantially total cutoff of IR transmission by dimethyl polysiloxane at about 2.2 microns. Although not all radiation in the IR spectral region shown in FIG. 4 is absorbed, small concentrations (about 0.001 to 10 wt %) of a dopant of an organic or inorganic solution which does not absorb in the UV region may be mixed with the dimethyl polysiloxane to increase the IR absorption.

A further attribute of dimethyl polysiloxane which renders it particularly desirable as a coolant for microwave excited plasma tubes in accordance with the invention resides in its negligible absorption of microwave energy at 2450 MHz, and high microwave power loading per unit volume resulting in high plasma radiation emitted in the UV, visible and near IR spectral regions. Microwave energy absorption of dimethyl polysiloxane as measured by two separate methods, viz., a microwave cavity technique (see Fein et al, "A Numerical Method for calibrating Microwave Cavities for Plasma Diagnostics - Part I", IEEE Trans Micr Theory and Tech 20:22 (1972) and Heald et al, *Plasma Diagnostics*, Wiley & Sons, New York (1954), Chap 5) and a balanced slotted line method (von Hippel, *Dielectric Materials and Applications*, Technology Press of MIT and Wiley & Sons, New York (1954), Chap 2) showed substantial agreement. In the more accurate method, i.e., that outlined by von Hippel, the real and imaginary components of the dielectric constant for dimethyl polysiloxane were determined as $\epsilon' = 1.5505$ and tan $\delta = \epsilon''/\epsilon' = 3.5 \times 10^{-4}$ or $\epsilon'' = 5.3 \times 10^{-4}$ respectively at 2450 MHz. The microwave absorption (tan $\delta$) is less than 0.00035, which equates to $<0.012\%$/cm at 2450 MHz. The low absorption value ($\leqq 0.2$ watt/cm per KW incident microwave power) is comparable to that of quartz. Resistivity of the liquid was measured to be greater than 100 MΩ·cm using a Bardstead Model PM-70CB conductivity bridge meter.

Figure 5:
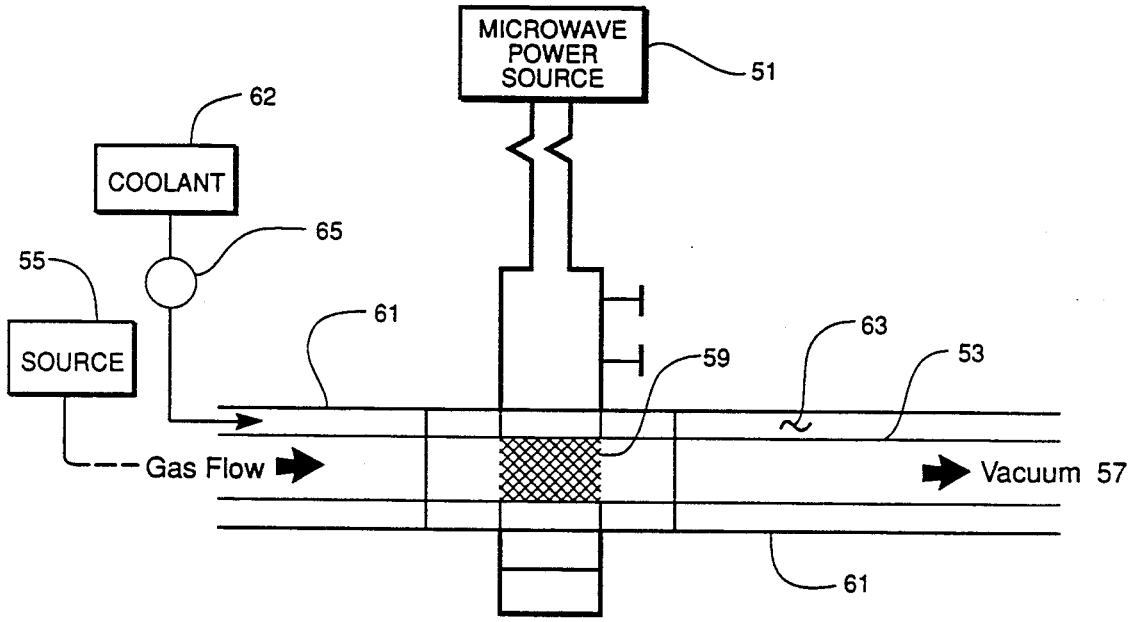
FIG. 5 is a schematic of a representative microwave excited plasma system incorporating the invention.

Referring now to FIG. 5, shown schematically therein is a 2450 MHz microwave excited plasma system incorporating the invention herein including a concentric tube liquid cooling jacket for a quartz plasma tube. The FIG. 5 system is representative of a resonant cavity type plasma system including microwave power source 51; quartz plasma tube 53 is operatively connected at a first end to gas source 55 and at the second end to vacuum means 57, and defines active plasma discharge region 59. Source 55 conventionally comprises nitrogen, inert gas, molecular gas, vaporous metal or halide salts suitable for supporting a plasma within region 59. Cooling jacket 61 surrounding plasma tube 53 is operatively connected to coolant source 62 and defines region 63 for containment and flow of liquid dimethyl polysiloxane into contact with the outer surface of plasma tube 53. In demonstration of the invention utilizing the system depicted in FIG. 5, both plasma tube 53 and jacket 61 were quartz, which is transparent to microwaves. The dimethyl polysiloxane coolant was cooled (30°–35° C.) and circulated using a conventional circulator 65. During more than an hour of transmitted microwave power (2. KW), nitrogen gas flow through plasma tube 53 produced a plasma in region 59 emitting intense UV radiation; no damage to plasma tube 53, jacket 61 or the liquid dimethyl polysiloxane occurred. It is noted that plasma tube 53, jacket 61 and all containers and transfer lines of the system may comprise the above mentioned materials or hard plastics for suitable containment of the liquid dimethyl polysiloxane and preservation of its desirable properties. No degradation in UV transmission of the dimethyl polysiloxane coolant was observed and the IR radiation was greatly reduced in the demonstration.

Figure 6:
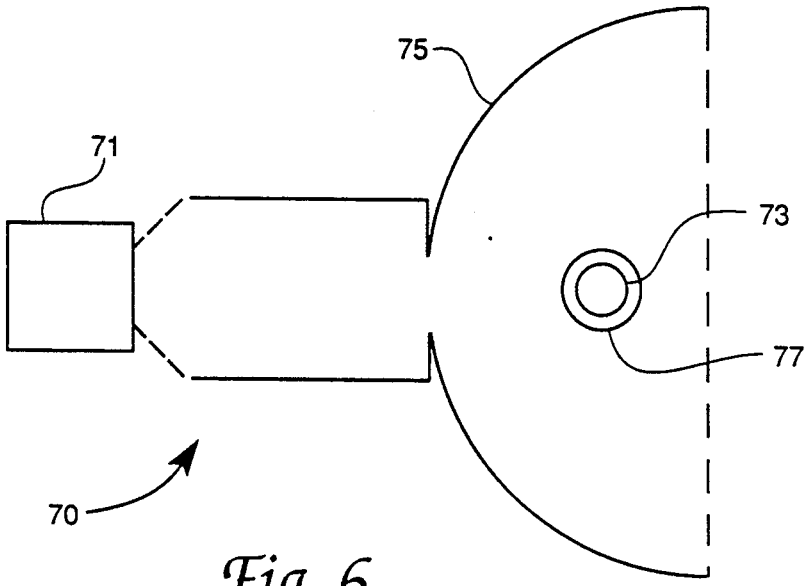
FIG. 6 is a schematic of a representative alternative microwave excited plasma system incorporating liquid cooling according to the invention.

FIG. 6 shows a schematic of a system representative of other high power microwave excited plasma tube configurations which may accommodate liquid cooling in accordance with the teachings of the invention. System 70 of FIG. 6 may include microwave power source 71, electrodeless quartz plasma tube 73, and reflector 75 of suitable shape (e.g. elliptical, spherical, parabolic, involute). Jacket 77 surrounds plasma tube 73 for flowing liquid coolant into contact with the outer surface of tube 73 in accordance with the invention. It is noted that the cooling configurations hereinabove discussed are only representative of numerous structures accommodating liquid flow according to the invention. Other flow schemes occurring to the skilled artisan practicing the invention can be accomplished using coaxial, transverse or other flow past the plasma tube, and are considered within the scope hereof.

The invention therefore provides a coolant system comprising liquid dimethyl polysiloxane for microwave excited plasma tubes. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A coolant system for a high power microwave excited plasma tube which comprises:

(a) a source of clean liquid dimethyl polysiloxane, said clean liquid dimethyl polysiloxane being dopted with an infrared absorbing material selected from the group consisting of organic and inorganic solvents;

(b) means for circulating said clean liquid dimethyl polysiloxane into heat exchange relationship with said plasma tube; and (c) wherein the containment materials comprising said source of said clean liquid dimethyl polysiloxane and comprising said circulating means is selected from the group consisting of a metallic material, a hard plastic, glass, pyrex and quartz.

2. The coolant system of claim 1 wherein said metallic material is selected from the group consisting of stainless steel, aluminum, and brass.

3. The coolant system of claim 1 wherein said hard plastic material is selected from the group consisting of plexiglas and acrylic.

* * * * *